United States Patent [19]

Fudman

[11] 4,113,190

[45] Sep. 12, 1978

[54] DEVICE FOR SHAVING ICE

[76] Inventor: Israel Fudman, 6300 Red Cedar Pl., Baltimore, Md. 21209

[21] Appl. No.: 814,448

[22] Filed: Jul. 11, 1977

Related U.S. Application Data

[63] Continuation-in-part of Ser. No. 688,372, May 20, 1976, abandoned.

[51] Int. Cl.[2] ..... B02C 18/12

[52] U.S. Cl. ..... 241/92

[58] Field of Search ..... 241/DIG. 17, 92, 100, 241/282.1, 282.2

[56] References Cited

U.S. PATENT DOCUMENTS

| | | | |
|---|---|---|---|
| 2,565,226 | 8/1951 | Gross, Jr. | 241/DIG. 17 |
| 2,646,223 | 7/1953 | Quintilian | 241/DIG. 17 |
| 2,665,852 | 1/1954 | Shively | 241/DIG. 17 |
| 2,684,207 | 7/1954 | O'Brien | 241/DIG. 17 |
| 3,552,663 | 1/1971 | Royal | 241/DIG. 17 |

*Primary Examiner*—Granville Y. Custer, Jr.
*Attorney, Agent, or Firm*—Walter G. Finch

[57] ABSTRACT

This invention relates to a device for shaving ice for use in the confections industry. The device comprises a series of components in concentric vertical alignment, at the top of which is an insulated hopper for charging the operating mechanism with a supply of chunks or pieces of ice in regular or random form or configuration, a revolving mechanism for shaving the ice and expelling the snow-like particles of ice through a chute, and a motor to cause the aforementioned mechanism to revolve. The parts of the revolving mechanism are removable through the hopper for cleaning without the use of tools. The actuator for the switching device for operating the motor is also removable without tools for cleaning and servicing. This improved device for shaving ice features a variation in textures of ice particles, a novel agitator to improve ice contact with shaving blades, total sanitary design, and improved disassembly construction.

12 Claims, 9 Drawing Figures

DEVICE FOR SHAVING ICE

This application is a continuation-in-part of U.S. Patent Application Ser. No. 688,372, filed by the applicant on May 20, 1976, for a "Device for Shaving Ice", now abandoned.

BACKGROUND AND SUMMARY OF THE INVENTION

The invention relates to ice shaving machine and in particular to those machines used to shave ice for edible concoctions, commonly called "snow-balls".

Machines have existed for sometime for shaving ice for use in the confections industry, such shaved ice being used for various purposes, including eatable concoctions. In recent years the health departments of may political sub-divisions have been clamping down on the processes used for producing the shaved ice and insisting on compliance with the rules and regulations on sanitary conditions. Such sanitary conditions relate to the cleaning of the ice shaving machines and this affects the facility for disassembly of the component parts in contact with the ice or in the areas of fabrication where contamination can become a factor in the various health department approvals. Many of the health departments of the various political sub-divisions accept an approval by the National Sanitation Foundations (NSF) as meeting the local sanitary requirements.

The present invention provides for meeting these current health department requirements for sanitary conditions by improving the design of ice shaving devices. The facility for disassembly is simple and easy, without tools, of those parts and areas directly associated with contact with the ice prior to shaving and with the shaved ice being processed, and with other moving parts and areas various health departments have considered to be points of contamination. Being easily disassembled encourages the compliance with the mandatory cleaning; being suitably designed eliminates the points of contamination cited in various health department inspections. The present invention has been approved by the National Sanitation Foundation, a fact which the inventor understands to be an approval not conferred upon any other similar device at this time.

The solid material comminution or disintegration to reduce the ice to small fragments, this invention can produce ice shavings that are of a snow-like consistency, is in part due to the relationship of the setting of the knife-edge of the ice shaving blade in relation to the aperture through which the shaved ice passes to the impeller mechanism. Variations in the size of ice fragments can be obtained by variations in the blade relationship to said aperture; this invention provides a means for such variation.

This invention provides for a variation in ice particle textures, an agitating means for assuring better contact with shaving blades, and finger emplacements to assist in disassembly, all novel features not found in other ice shaving machines.

The invention generally comprises a rectangular housing in which the series of components comprising the device for shaving ice are arranged in a concentric vertical alignment on a common centerline.

An insulated hopper for ice is at the top of the concentric vertical alignment of the parts with interior sides sloping slightly toward a transition section. A cover for the hopper is provided.

The transition section changes from the rectangular configuration to a circular configuration. One or more baffles are in the transition section to restrict the movement of chunks of ice in the hopper.

One item in the comminution mechanism serves as an agitator to vibrate the pieces of ice downward to the comminution mechanism which is at the bottom of the transition section.

Design of the interior of the hopper and other parts are such that they comply with controlling health department requirements. The details are covered later in the Description of the Preferred Embodiments.

The driving mechanism for the comminution mechanism is mounted directly below it. The enclosure for the driving mechanism terminates in a base that supports the entire ice shaving device.

A special coupling mechanism connects the driving mechanism to the comminution mechanism. The comminution mechanism is arranged for easy disassembly without the use of tools.

A discharge chute is provided for the shaved ice from the comminution mechanism to the exterior of the housing. An operating switch for the mechanism is provided in the vicinity of the discharge chute.

Provisions are made for insulating the housing that encloses the ice shaving device.

The materials in the aforementioned rectangular housing are preferably stainless steel, but it is to be understood that the use of other materials is within the scope and intent of this invention. Likewise, material of the hopper may be a plastics of a type approved by the controlling health department for contact with food products of the type used in ice shaving machines or any other materials that are suitable and approved for sanitation purposes. The variation of such materials should also be understood to be within the scope and intent of this invention.

For sanitary purposes, the interior corners of all parts of the hopper are rounded by an interior radius fillet at the junctures of any two sides or two adjacent planes of any part, but it should be understood that any use of other shaped fillets or other method of forming the juncture is within the scope and intent of this invention. The preferable embodiment is monolithically formed or a moulded insert for the combination of which forms the total volume of ice storage supply of the charging hopper. Specifically, these sanitary aspects of this invention are not present in the present art.

Accordingly, it is a primary object of the invention to provide a device for shaving ice for the confection industry that is easily disassembled for cleaning in accordance with the growing demand of health departments in various political sub-divisions for improved sanitary conditions.

It is a further object of the invention to provide simple means for the disassembly of the comminution mechanism that is to be cleaned It is another object of the invention to provide a shaving blade assembly on a carrier plate that has a relation to each other and an exit aperture that will produce a fine texture of shaved ice of snow-like consistency.

It is still another object to provide a simple electric switch activator that is easily removable for cleaning.

Further objects and advantages of the invention will become more apparent in the light of the following detailed description of the preferred embodiment of the invention.

BRIEF DESCRIPTION OF THE INVENTION

DESCRIPTION OF THE PREFERRED EMBODIMENTS

Figure 1:
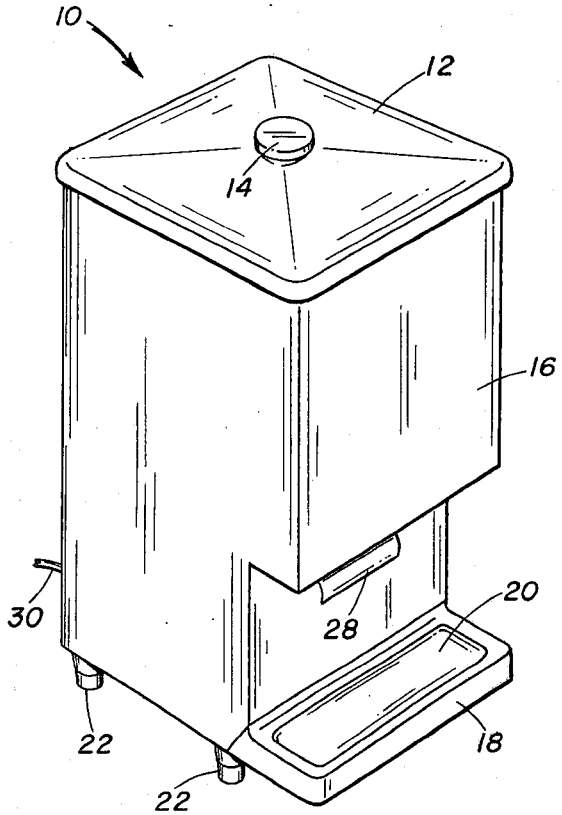
FIG. 1 is a perspective view of the device.

The embodiment of the invention shown in the drawings essentially operates according to the method of the invention, the device components shown being merely illustrative since a variety of other device components could be used in the practice of the invention without departing from the scope or intent of the invention.

As noted hereinabove, the invention contemplates the shaving of ice to a fine texture and consistency for use in the confections industry, but provides for shaving ice to a variety of textures and consistencies.

Referring now to the drawings, it can be seen relative to FIG. 1 that the invention can be configured as a specific device 10 as the embodiment of the invention.

In FIG. 1 a rectangular housing 16 for the device encloses the components of the device 10 as will be described later. The rectangular housing 16 is also seen from other angles in FIGS. 2, 3, and 4.

Figure 2:
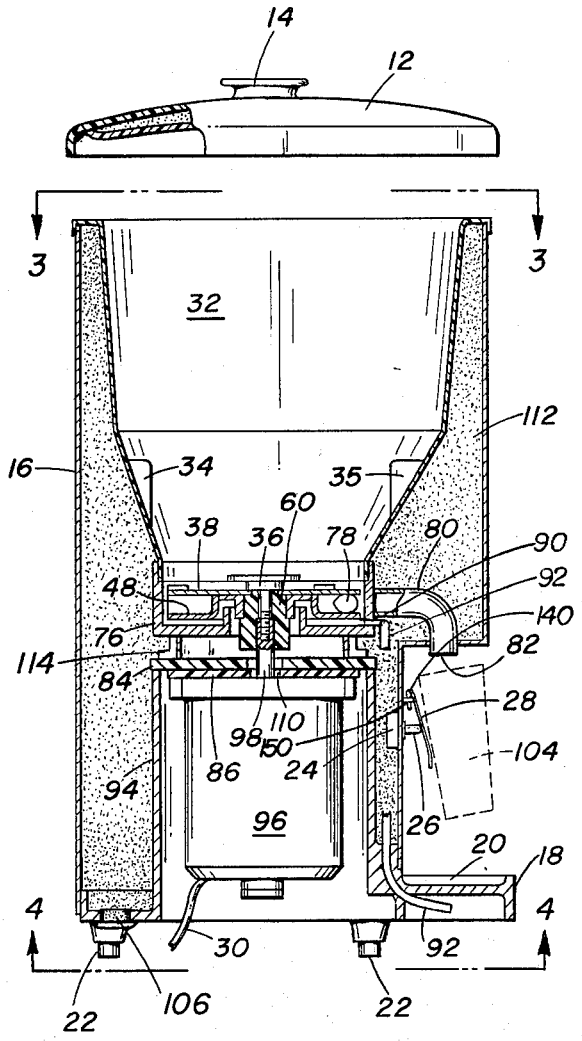
FIG. 2 is a cross-sectional view on lines 2—2 of FIGS. 3 and 4 through a center-line showing a side elevation of the cross section.

In FIGS. 1 and 2 a cover 12 for the entire device 10 fits over the rectangular housing 16 and encloses the charging hopper 32 which will be described later. The cover can be lifted and handled by the knob 14. A trough 20 in the form of a tray as part of the base 18 provides for catching the dripping water and particles of shaved ice that may come from discharge end 82 of the shaved ice discharge chute 80.

Figure 3:
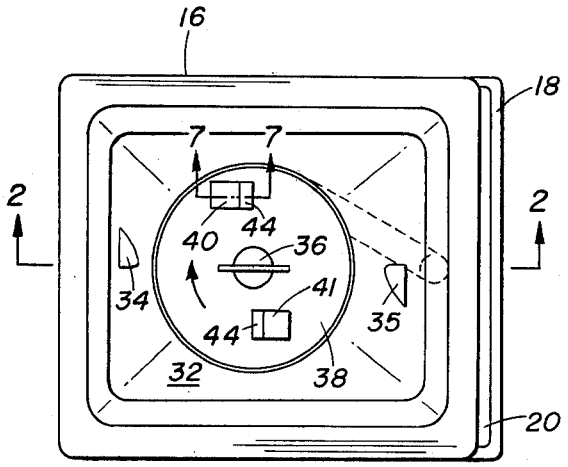
FIG. 3 is a top view of the device with the cover removed.
Figure 4:
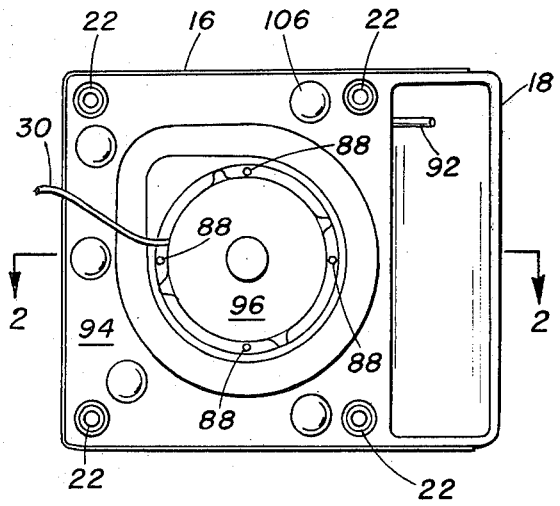
FIG. 4 is a bottom view of the device.

The series of components of the device 10 are assembled in concentric vertical alignment as will now be described from FIGS. 2, 3, and 4.

A charging hopper 32 with the upper edges of the walls aligned parallel with the configuration of the rectangular housing 16 and overlapping and said rectangular housing 16 at the top edge to form a tight joint thereat. Inside the charging hopper 32 the walls slope slightly inwardly to a point slightly below the midpoint of the total depth of the charging hopper 32. This charging hopper 32 is used for storage of chunks and pieces of ice as the supply for producing the shaved ice. At this lower point described hereinabove as just below the midpoint of the total depth of the charging hopper 32, the slope of the walls increases sharply and the rectangular shape of the charging hopper 32 begins a transistion to a circular configuration just above the comminution mechanism shaving blade carrier plate 38 which will be described later. The diameter of the lower circular section of the charging hopper 32 is slightly larger than rotatable shaving blade carrier plate 38 to provide clearance when the carrier plate 38 is rotating.

It should be noted that a first embodiment of a carrier plate 38 and a hand screw 36 are shown and described first. Later, a second embodiment of a carrier plate 116 and a combination hand screw and agitator 129 with a compression plate 134 are shown and described. The latter carrier plate 116 and the combination hand screw and agitator 129 comprise the preferred embodiment.

Within the aforementioned charging hopper 32 and in the beforementioned transition section of the charging hopper 32 there are located one or more baffles 34 and 35. These baffles 34 and 35 extend inwardly to resist, impede, and interfere with the turning motion of the ice as the revolving carrier plate 38 tends to force the ice into a spinning motion as one or more shaving blades 40 and 41, which are welded onto the revolving carrier plate 38, engage the ice chunks and pieces in order to shave it.

At the bottom of the charging hopper 32 where the configuration is circular, the circular section of the charging hopper 32 extends downward to form a collar to facilitate fitting it to the comminution mechanism housing 76. The comminution mechanism housing 76 is recessed similar to a counter-bore to accept the collar formation at the bottom circular section of the charging hopper 32. When mated and joined the inside surface of the circular collar at the bottom of the charging hopper 32 is flush with the inside surface of the comminution mechanism housing unit 76 below the recess formed in the housing unit 76 to accept the collar of the charging hopper 32. The center opening of the comminution mechanism housing unit 76 which provides clearance for the coupling 60 described later, is constructed with a raised wall at the center opening in order to retain accumulated water until it drains by gravity out through drain port 90 and dischrge tube 92. This prevents the water from seeping down toward the motor.

Below the outside surface of the bottom of the comminution mechanism housing unit, parallel to it, and vertically spaced from said bottom surface of the housing unit 76 are support members 84 and 86 for motor 96. The vertical spacing for support members 84 and 86 is accomplished by lugs 114 attached to the bottom surface of the comminution mechanism housing unit 76 and a circular spacer.

The surface members 84 and 86 rest on a nearly circular housing chamber 94 for the motor 96. The housing chamber 94 is essentially circular except for the modificaiton on one portion to conform with the configuration of the units on the commercial motor 96. This nearly circular housing chamber 94 extends vertically downward and terminates in, and as part of, the base 18 of the device 10. The base 18 extends forward to form the trough 20 aforementioned. All of the hereinbefore mentioned components (charging hopper 32, shaving blade carrier plate 38, comminution mechanism housing unit 76, support members 84 and 86, motor 96, and housing chamber 94) are all concentric vertical alignment as aforementioned.

At the bottom of the base 18 are four legs 22, adjustable for leveling the device 10.

The sides, front, and back of the rectangular housing 16 extend downward from the top edge of the charging hopper 32, with the sides and back extending downward to the base 18, and the front being recessed to provide clearance for the discharge end 82 of the discharge chute 80 and the activator plate 28 that activates the spring-loaded switch 26. Thereafter the front of the rectangular housing 16 continues downward to the base 18. The left and right sides of the rectangular housing 16 are configured to match the recesses of the front panel of the rectangular housing 16. The said front panel meets and joins the base 18 at the back of the trough 20.

Insulation 112 in the form of foamed plastics is inserted as hereinbefore described by pouring the liquid plastics chemical ingredients just after mixing into access holed in the bottom of the base 18 so that the foamed liquid expands to fill all the voids around the charging hopper 32, the comminution mechanism housing unit 76, and the other voids between the rectangular housing 16 and the various components. As hereinbefore described, the holes are capped off by inserting snap-in discs 106 into the holes before the expanding foam reaches the point where it will begin to exude out through the access holes. Thus a cast-in-place insulation 112 is accomplished that provides a thermally insulated charging hopper 32 as well as insulation for the other sections of the device 10. When totally cured the cast-in-place foamed insulation 112 secures in place all of the aforementioned concentric vertically aligned components that formed the void with the rectangular housing 16. As aforementioned, other forms of insulation may be used instead of the foamed cast-in-place type of insulation and such use of other insulation is within the scope and intent of this invention.

Turning now to the comminution mechanism of device 10 that produces the shaved ice, refer to FIGS. 2, 3, 4, 5, 6, and 7.

The motor 96 is assembled to the mounting plates 84 and 86 by screws 88 that pass through clearance holes in support member 86 and screw into holes 108 in support member 84, the screws are internal socket head type to facilitate assembly, and disassembly when maintenance is required. The motor is located inside the motor housing chamber at the bottom of the concentric vertically aligned series of components. The shaft 98 of the motor 96 extends vertically upward through support plates 84 and 86 and into the lower end of coupling 60, described later. The top or upper end of shaft 98 is drilled and tapped, in the longitudinal direction of shaft 98, with a left hand thread 100. The threads 100 are to receive and accept the left hand threads on clamping screw 36 when the clamping screw 36 is inserted through the shaving blade carrier plate 38, the impeller 48, and the coupling 60 to be screwed into the threads 100 of the upper end of the shaft 98 in order to clamp the listed mechanism parts together tightly. The upper end of the shaft 98 is provided with a keyway 102 on the outside of said shaft 98 to provide a means for locking said shaft 98 to said coupling 60 with a key (not shown) inserted in said keyway 102 and mating it with keyway 70 in said coupling 60. A watertight bearing 110 is fitted into support 86 to seal the opening around the shaft 98.

The coupling 60 is composed of two dissimilar diameters 72 and 74. The lower diameter 74 at the bottom of coupling 60 as viewed when it is assembled is the larger of the two diameters and the top section 72 is the smaller diameter. The shoulder provided at the point where the larger diameter 74 on the bottom section steps inwardly to form the smaller diameter 72, provides a seat for the cup-type flange on the bottom on impeller 48. The inside of the coupling 60 is drilled 62 through the top small diameter section 72 to accept the shank of the hand screw 36. The hole 62 is counterbored 68 to accept the motor shaft 98, the shaft 98 bottoming or resting on the shoulder at the depth of the counterbore 68. The coupling has a keyway 70 on the inside of the counterbore 68 in the large diameter section 74 to provide for a key to lock the coupling 60 to the motor shaft 98 in keyway 102. In a like manner the coupling in the small diameter section 72 has a key 64 to lock the coupling 60 to the impeller 48 (described later) by locking the key 64 into keyway 54 in the centerbore 52 in the impeller 48. On the top end surface of the small diameter section 72 are projections 66 and 67 that serve as a form of key device to fit into shaving blade carrier plate 38 (described later) by inserting projection 66 into the centering hole 56 of the said carrier plate 38 and inserting the projection 67 into any one of the two opposite slots 58. The mating of these male projections 66 and 67 into the female openings 56 and 58, respectively, serves to prevent the carrier plate 38 from slipping when the comminution mechanism is rotating.

When the aforesaid impeller 48 is placed on the coupling 60 as hereinbefore described, and then the shaving blade carrier plate 38 is assembled on top of the impeller 48, the impeller vanes 50 and 51 form two recesses in the enclosed area between the aforesaid assembled impeller 48 and the shaving blade carrier plate 38, one such pocket or chamber-like recess is on each side of the combination of the impeller vanes 50 and 51. When the impeller 48 rotates when the ice shaving device 10 is in operation, the shaved ice that has entered the chamber-like recesses is impelled off the impeller 48 by centrifugal force and subsequently through the discharge chute 80 and then out through the discharge end 82 of the chute 80.

To hold the assembled components aforementioned in a fixed compact, and secure position, a hand screw 36 is inserted into the center hole 62 in the coupling 60 and screwed into the threaded hole 100 in the end of the motor shaft 98. The threads on hand screw 36 and in the threaded hole 100 are left hand threads to prevent the hand screw 36 form loosening or backing off under operation. When hand screw 36 is tightened down the round compression plate of the hand screw 36, compresses against the top of the carrier plate 38 and secures all of the components in concentric vertical alignment. The said round compression plate of the hand screw 36 can be seen at the top of FIG. 5 as that part of the hand screw 36 immediately under the bar used to manually turn the said hand screw 36. The outside diameter of the compression plate on the hand screw 36 is larger than the centering hole 56 in the carrier plate 38 and thereby secures the said carrier plate 38 in place and as a result, the other components under the carrier plate 38 that are in concentric vertical alignment on the coupling 60.

As hereinbefore mentioned, hand screw 36 is a first embodiment, a second embodiment of a combination hand screw and agitator 129 is the preferred embodiment, particularly in connection with a hereinafter described carrier plate 116.

The combined hand screw and agitator 129 consists of a screw portion 132 (left hand threads) and a "U" shaped top 130. The combined hand screw and agitator 129 is installed with a composition washer 134 (such as a plastics) under it to serve as a compression plate to compact the parts of the comminution mechanism together.

The "U" shaped top 130 of the combined hand screw and agitator 116 serves as a gripping point for the operator's hand to tighten or loosen the hand screw. The "U" shaped top 130 also serves as an agitator as it spins within the chunks of ice around it to vibrate the ice chunks downward to the cutting or shaving blades 124 (hereinafter described). Note that the aforementioned baffles 34 and 35 prevent the ice from spinning or turning in a circle as a unit, while the "U" shaped top 130 spins in the center and by its agitation vibrates the ice downward to the cutting or shaving position for positive contact.

It is to be noted that the hand screw permits disassembly for cleaning without the use of tools. Once the hand screw is removed all of the comminution mechanism components and the coupling unit can be removed easily in a vertical direction through the charging hopper.

Figure 5:
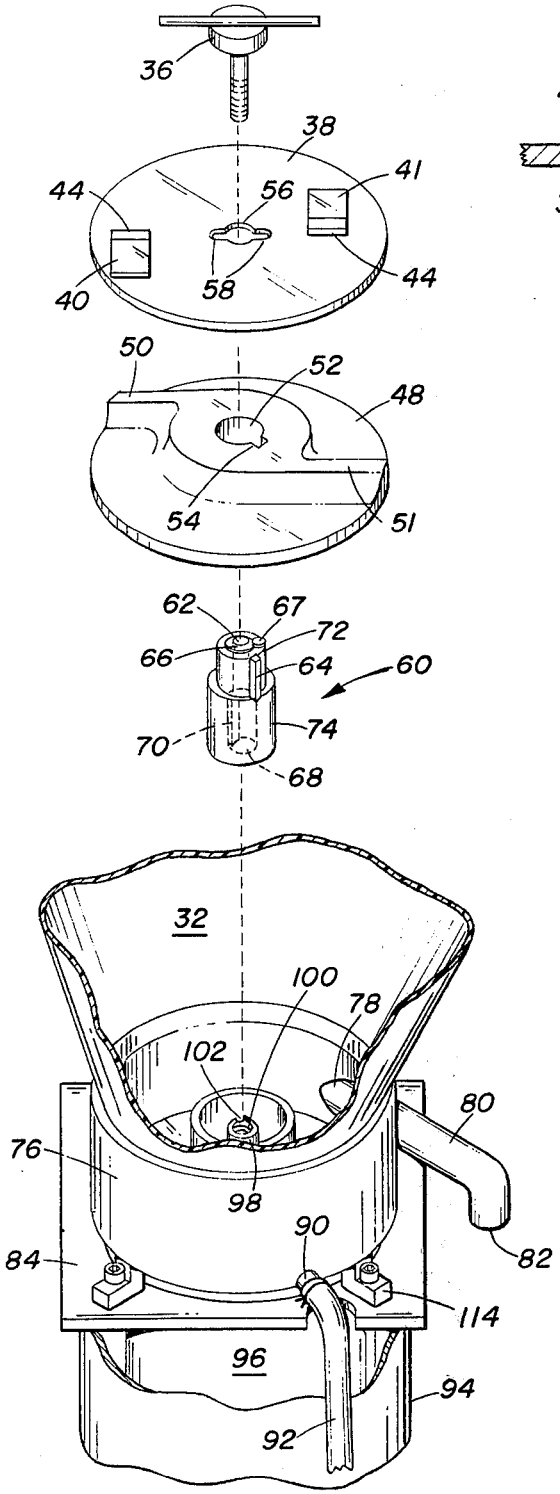
FIG. 5 is a partial exploded view showing the disassembly of components of the comminution mechanism.
Figure 7:
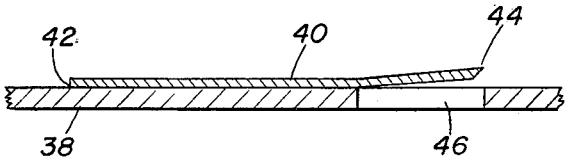
FIG. 7 is a partial cross-sectional view 7—7 of FIG. 3 showing the shaving blade assembly on the carrier plate.
Figure 6:
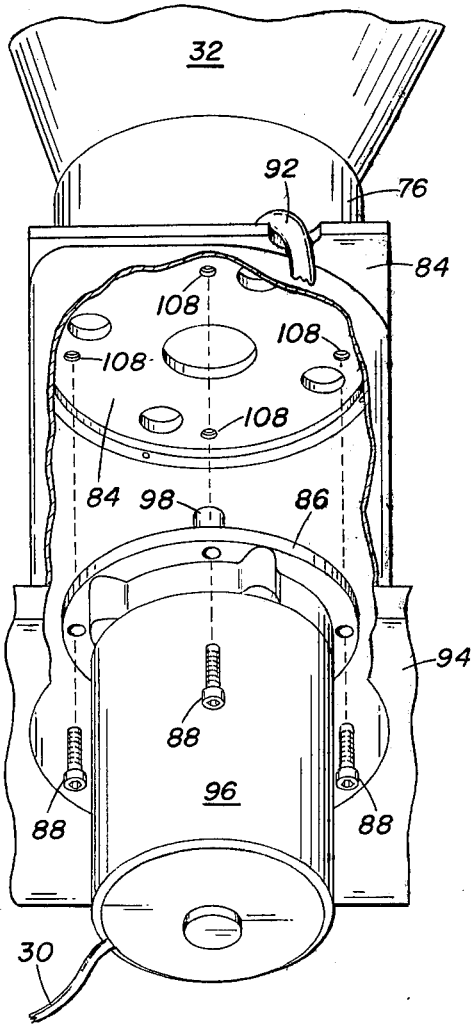
FIG. 6 is a partial exploded view showing the removal of the motor.
Figure 8:
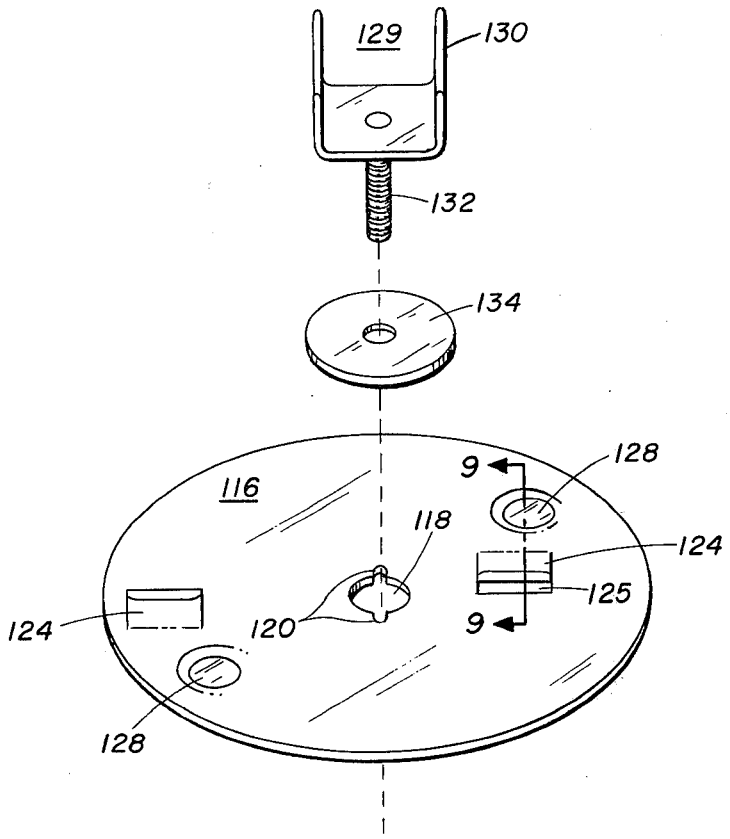
FIG. 8 is an exploded view of a carrier plate with integrally formed cutting blades and hold-down parts.
Figure 9:
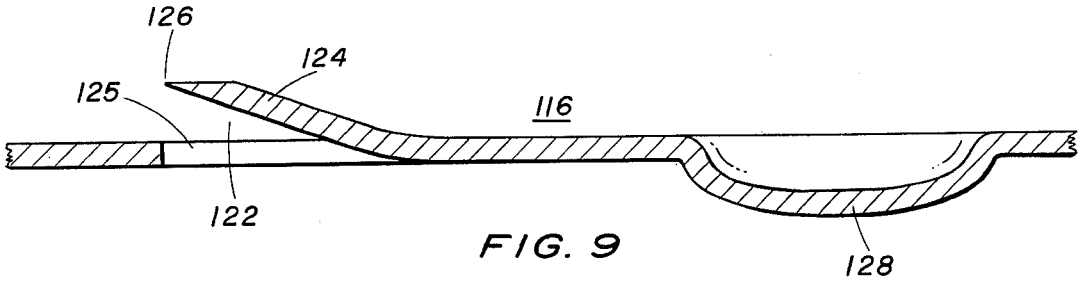
FIG. 9 is a partial cross-section view 9—9 of FIG. 8 showing integral shaving blade and finger dimple.

Referring to FIG. 7, one or more shaving blades 40, such as shaving blades 40 and 41 in FIG. 5, are welded at point 42 to the shaving blade carrier plate 38. The cutting edge 44 of shaving blade 40 as positioned in relation to the carrier plate 38 and the aperture 46 determines whether a finely textured consistency of shave ice is produced, having a snow-like appearance that is superior to the ordinary shave ice produced by other existing machines, or whether the texture will be coarse. Trial and error at the manufacturing point can produce blade settings for any desired texture. To provide for a selection of various ice particle textures a series of carrier plates is provided with blades set at various angle relationships to the carrier plate surface and the aperture beneath the blade. The shaved ice passes through the aperture 46 as it is shaved and into one of the chamber-like recesses in the aforementioned impeller 48. The discharge of the shaved ice by the impeller 48 has been hereinbefore described.

As aforementioned, a carrier plate 38 with its shaving blades 40 and 41 is a first embodiment. A second and preferred embodiment is a carrier plate 116 with intergrally formed blades 124 pressed out (122) of the surface of the carrier plate 116. This carrier plate 116 has a cutting edge 126 on the blades 124 and an aperture 125 under the blades 124. It has a centering hole 118 and keyways 120 as hereinbefore described and used in the first embodiment. In addition, the second embodiment of the carrier plate 116 has two finger dimples 128 so that the plate may be held steady when loosening the clamping means.

Water accumulating in the comminution mechanism housing unit 76 is drained through the drain outlet port 90 and thence through hose or tube 92 to a convenient discharge point below the level of the operating portion of the device.

Electrical current for the motor operation is provided through the electrical connection 30. Control of the electrical system is provided by a spring-loaded switch 26 that can be easily removed for servicing the switch mechanism 24 by removing retaining screws on the front plate of switch 26 that attaches the said switch 26 to the front panel of the rectangular housing 16. Simple operation of the spring-loaded switch button 26 is provided by an activator plate 28 which, when depressed or pressed inwardly by a cup, glass, or other container 104 for receiving the shaved ice as it is discharged, will force the spring-loaded switch button 26 into the "on" position and cause switch mechanism to start the motor 96 and thus the comminution mechanism hereinbefore described in detail. Removal of the cup, glass or other container 104 permits the spring-loaded switch button 26 to return to its "home" position of "off", shutting off the motor 96 and stopping the operation of the device 10. At the same time, as the spring-loaded switch button 26 returns to its "home" position, the activator plate 28 also returns to its original position as the said spring-loaded switch button 26 presses against it. The activator plate 28 has a novel method of mounting it that makes it simple to remove and clean it and also clean under the activator plate 28 around the spring-loaded switch button 24. The activator plate 128 has a open lip 140 at the top side that merely hangs over a bar 150 on the front panel of the rectangular housing 16 and serves in the same capacity as a permanently attached hinge. The open lip 140 is formed as shown in FIG. 2 by bending the uppermost edge of the activator plate 28 into a "U" shaped return or bend. The "U" shaped return or bend, seen in end view in FIG. 2, forms said open lip 140. Width of activator plate 28 can be seen in FIG. 1. The fixed bar 150 is seen in end view in FIG. 2 with the rear-most part of said "U" shaped return, or bend, passing over and behind said fixed bar 150. In other words, as illustrated in FIG. 2, the "fixed bar 150" at the point where the "open lip 140" hooks over it, must be slightly wider than the illustrated width of the "fixed bar 150" in FIG. 1. The bar 150 is "fixed" in that the ends are bent at 90° and attached (in other words "fixed") to the front panel of the lower portion of the rectangular housing 16 just above the switch button 26 in FIG. 2.

As should be apparent from the description provided of the embodiment of the invention, other ice shaving device designs could be employed for the method of the invention without departing from the scope of the invention, and it should be apparent from the description provided that the use of other materials, shapes of components, positioning of components and other similar modifications could be used for the method of the invention without departing from the scope of the invention as defined by the appended claims.

What is claimed is:

1. A device for producing shaved ice having a range of ice textures from very fine to very coarse and comprising:

a hopper means for holding a supply of random size chunks of ice;

an agitator means positioned below said hopper means to agitate said chunks of ice in said hopper means;

a comminution system containing a range of preadjusted ice shaving components to produce said range of ice textures, said comminution system being coupled to said agitation means;

at least one baffle positioned within said hopper means and monolithic with said hopper means to impede turning of total ice mass, said baffle being located clear of disassembled parts of said comminution system that are removed in a vertical direction through the charging hopper;

an electrical switch means;

an activator having an open lip on the uppermost edge of said activator, a bar attached to the outside of said device for producing said shaved ice, said open lip passing over and behind said bar and thereby mounting said activator for controlling said electrical switch means;

power means coupled to said comminution system and controlled by said activator mounted by said lip on said bar controlling said electrical switch means;

a delivery system located adjacent to said comminution system and communicating therewith for delivery of shaved ice to exterior of said device for producing shaved ice.

2. The device for producing shaved ice as recited in claim 1, wherein said hopper means consists of:

a monolithic hollow charging section, substantially rectangular in shape, having an open top end and an open bottom end spaced apart from said top end, and having all rounded interior corners;

a transition section, monolithically formed, substantially rectangular at an open top end and substantially circular at an open bottom end spaced apart from said top end, said substantially rectangular top end mating with and monolithically connected to said open bottom end of said charging section, and having all rounded interior corners; and at least one baffle within said transition section to impede ice from turning, said baffle projecting inwardly from interior surface of said transition section, and monolithic with said transition section, and having all rounded corners on exterior surfaces of said baffle and all rounded corners at interface with said transition section, said baffle extension inwardly from said interior surface of said transition section not extending past edge of said circular open bottom end of said transition section.

3. The device for producing shaved ice as recited in claim 1 and additionally, an enclosure casing around the entire assembled unit and wherein thermal insulation is introduced to fill all voids between said enclosure casing and assembled component parts.

4. The device for producing shaved ice as recited in claim 1 wherein said activator comprises a flat plate having a width and a length, and having one edge of said width bent in a "U" shaped turn so that original edge of said width is spaced from the plane of the underside of said flat plate, said "U" shaped turn forming an open lip, said open lip being capable of hanging over bar of lesser diameter than the space between original edge of said width of flat plate and the plane of the underside of said flat plane.

5. The device for producing shaved ice as recited in claim 4 wherein said bar over which said open lip hangs comprises a bar of lesser diameter than the space between original edge of said width of flat plate and the plane of the underside of said flat plate, the length of said bar under said open lip extending to outside of said open lip at which point said bar on each side of said open lip is bent at 90° to attach to outside surface of said device for producing shaved ice.

6. The device for producing shaved ice as recited in claim 1, wherein said comminution system consists of:

at least one ice shaving blade;

a flat circular plate carrier means for holding at least one said ice shaving blade and having an aperture through said plate under said blade;

a circular impeller means immediately below said circular plate carrier means, having at least two diametrically opposite curved vanes on the upper surface of said impeller means, said vanes dividing said impeller means into at least two sections;

a coupler means for holding said carrier means and said impeller means together in permanent alignment;

a housing means for housing said ice shaving blade, said circular plate carrier means said impeller means, and said coupling means when all are assembled as a unit; and a securing means for compacting and compressing the aligned said circular plate, said impeller, and said coupling means, within said housing means.

7. The device for producing shaved ice as recited in claim 6, wherein said agitating means consists of a "U" shaped extension on said securing means.

8. The device for producing shaved ice as recited in claim 6, wherein said power means consists of:

an electric motor; and a shaft for connecting to said coupling means, and having an internal thread in the outboard end of said shaft to receive said securing means.

9. The device for producing shaved ice as recited in claim 6, wherein said delivery system consists of:

a hollow pipe-like chute connecting to the exterior of said housing means and communicating with the interior of said housing means, the opposite end of said chute being positioned to deliver said shaved ice to a suitable container.

10. The device for producing shaved ice as recited in claim 6, wherein said ice shaving blade is welded to said carrier means.

11. The device for producing shaved ice as recited in claim 6, wherein said ice shaving blade and said circular plate carrier means are integrally formed and additionally said carrier means has finger dimples to aid in disassembly of said comminution system.

12. The device for producing shaved ice as recited in claim 11, wherein said integrally formed ice shaving blade and circular plate carrier means are provided in a series of assemblies having a range of ice shaving blade adjustments in relation to the said carrier plate and said aperture therein to produce a range of shaved ice textures to permit selection of texture desired.

* * * * *